US005199678A

United States Patent [19]

Luebke

[11] Patent Number: 5,199,678

[45] Date of Patent: Apr. 6, 1993

[54] CUP HOLDER

[76] Inventor: Aaron Luebke, P.O. Box 154, Okawville, Ill. 62271

[21] Appl. No.: 836,096

[22] Filed: Feb. 14, 1992

Related U.S. Application Data

[63] Continuation-in-part of Ser. No. 682,541, Apr. 8, 1991, abandoned.

[51] Int. Cl.[5] ..... A47C 7/62

[52] U.S. Cl. ..... 248/311.2; 248/231; 248/214; 248/205.2; 297/194

[58] Field of Search ..... 248/311.2, 205.2, 214, 248/231; 297/194, 188

[56] References Cited

U.S. PATENT DOCUMENTS

| | | | |
|---|---|---|---|
| 3,155,355 | 11/1964 | Cappola | 248/74.3 |
| 3,586,368 | 6/1971 | Guild . | |
| 4,256,281 | 3/1981 | Harris et al. . | |
| 4,339,061 | 7/1982 | Dunn . | |
| 4,606,523 | 8/1986 | Statz et al. | 248/311.2 |
| 4,634,089 | 1/1987 | Wright et al. . | |
| 4,721,276 | 1/1988 | Moss . | |
| 4,728,147 | 3/1988 | Dutton | 297/194 |
| 4,779,831 | 10/1988 | Anderson . | |
| 4,915,337 | 4/1990 | Iwasaki . . | |
| 5,042,770 | 8/1991 | Louthan . | |

*Primary Examiner*—Alvin C. Chin-Shue
*Attorney, Agent, or Firm*—Robbins & Robbins

[57] ABSTRACT

A cup holder (10) for holding a cup (C) or the like in place. The cup holder is attachable to an arm of a leisure-type chair or other type chair in which space is provided below its arms. The holder has a support (20) including a horizontal support arm (24) which extends over the top of the chair arm and retaining flange (26) which bears against the inside edge of the chair arm.

A binding strap (32) attached to the underside of horizontal arm (24) extends underneath and around the chair arm and over the top of the support. The strap is attachable to the horizontal support arm to firmly attach the cup holder to the chair arm.

5 Claims, 2 Drawing Sheets

CUP HOLDER

RELATED APPLICATION

The present application is a continuation-in-part of Ser. No. 07/682,541 filed Apr. 8, 1991.

BACKGROUND OF THE INVENTION

This invention relates to beverage holders, and more particularly, to a beverage holder for soda cans and the like which is removably attached to various types of lawn chairs or similar type leisure chairs.

It is known to attach holders for beer and soda cans to the arm of a chair such as lawn chairs. See, for example, U.S. Pat. Nos. 4,728,147 to Dutton; 4,915,337 to Iwasaki; 3,586,368 to Guild; 4,779,831 to Anderson; 4,721,271 to Moss; 4,634,089 to Wright; and 4,339,061 to Dunn. While various of these patents, Dutton for example, teach cup holders for use with leisure type furniture, all work only with one or a limited number of types of such furniture. What would be beneficial would be a cup holder which is usable with lawn chairs that have L-shaped arms, tubular arms, arms with various thicknesses, etc. In addition, it would be helpful if the holder were available in different sizes so that cups, thermos', soda and beer cans, two-liter bottles, etc. could be supported on the arm of the chair where they would be easily accessible to someone. Otherwise, these containers wind up sitting on the ground where they can be inadvertently knocked over.

SUMMARY OF THE INVENTION

Among the several objects of the present invention may be noted the provisions of a cup or beverage container holder; the provision of such a holder to be of various sizes so to accommodate cups, small and large beverage containers such as soda or beer cans and two-liter size beverage containers; the provision of such a holder which is readily, removably attachable to the arm of leisure-type chair, for example, the arm of a lawn chair; the provision of such a holder which is attachable to a variety of arm configurations yet which is firmly attached to each type of arm and does not sag, twist, bend or otherwise become displaced; the provision of such a holder which is readily removable from the arm; and, the provision of such a holder which is low cost, light weight, and easily stored.

Briefly, a cup holder of the present invention includes a holder in which the cup is settable. A support is provided for supporting the holder on one side of a chair arm, the support including an arm extending along the top of the chair arm with a retaining flange bearing against an inner edge of the chair arm. An attachment for attaching the holder to the arm includes a strap affixed to the underside of the support arm and wrappable beneath the chair arm and around over the top thereof. The strap is secured to the top of the support arm.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

Corresponding reference characters indicate corresponding parts throughout the drawings.

DESCRIPTION OF THE INVENTION

Figure 1:
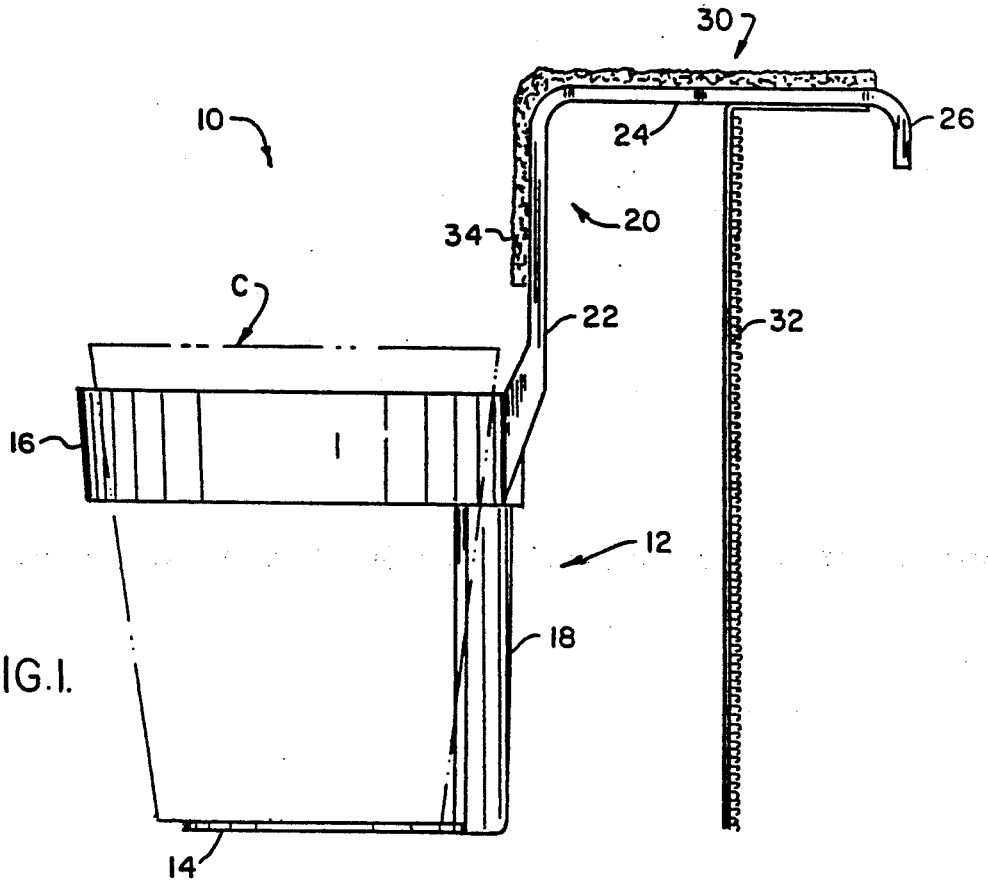
FIG. 1 is a side elevational view of a cup holder of the present invention.
Figure 2:
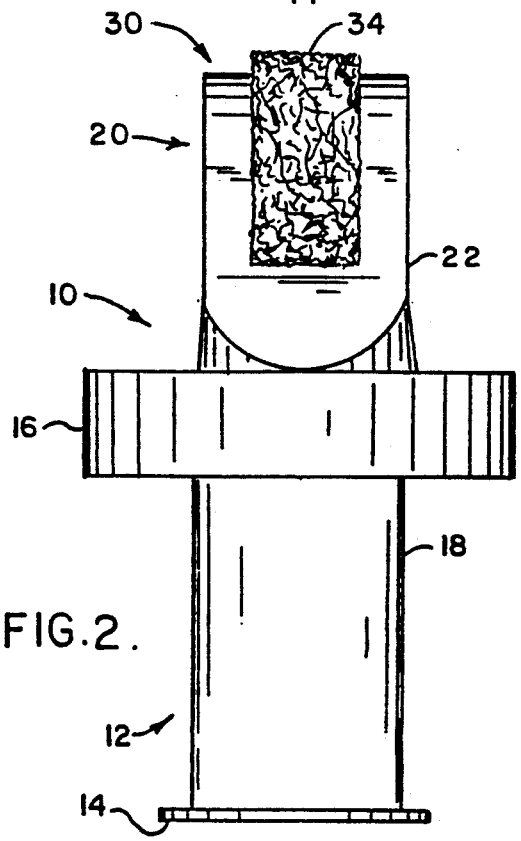
FIG. 2 is a front elevational view of the holder.
Figure 3:
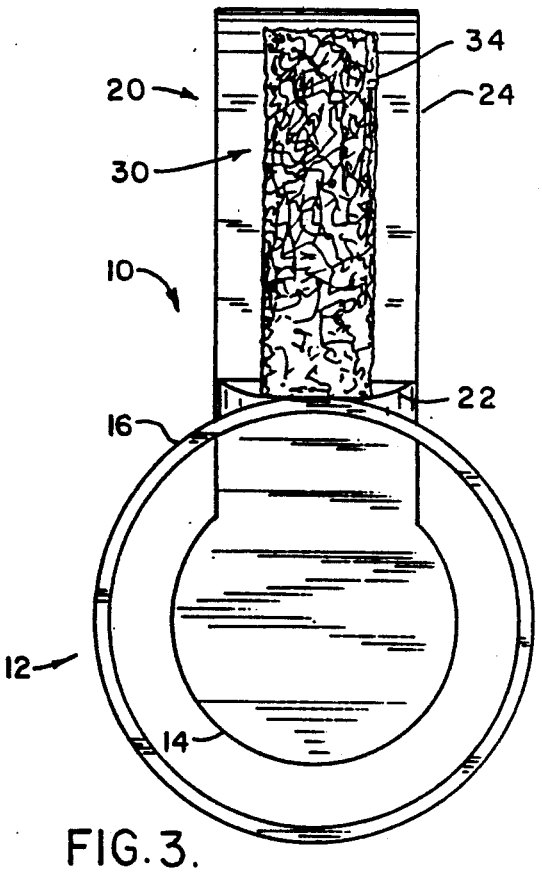
FIG. 3 is a top plan view of the holder.

Referring to the drawings, a cup holder of the present invention is indicated generally 10. The cup holder is generally similar to conventional cup holders in that it includes holder means 12 in which a cup C is settable. It will be understood that the cup holder may be of various sizes to accommodate different size cups and including bottles such as the two-liter type bottles in which various types of carbonated beverages are contained. The holder can also be sized to hold beer cans, and other types of bottles and containers. The holder means has base 14 upon which the bottom of the cup or container rests. The base is shown in FIG. 3 as being generally round, although other convenient shapes may be formed. The holder means further includes a circular ring 16 of any convenient diameter. The ring is spaced above the base and is attached thereto by a stem 18. The width of the stem is sufficient to support the base even when a fully loaded container is set upon it.

Figure 4:
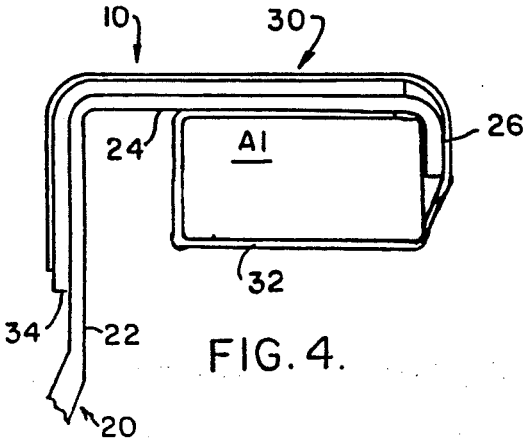
FIGS. 4–8 are installed views of the cup holder on various types of chair arms.
Figure 5:
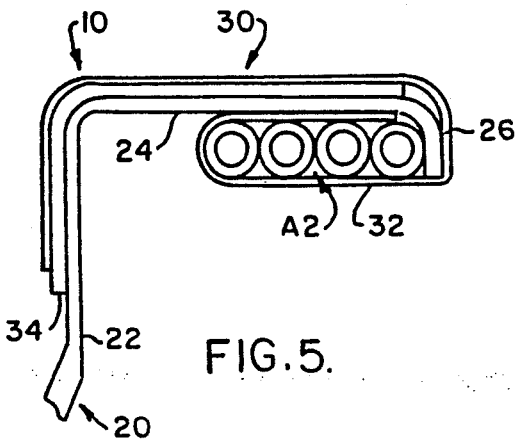
Figure 6:
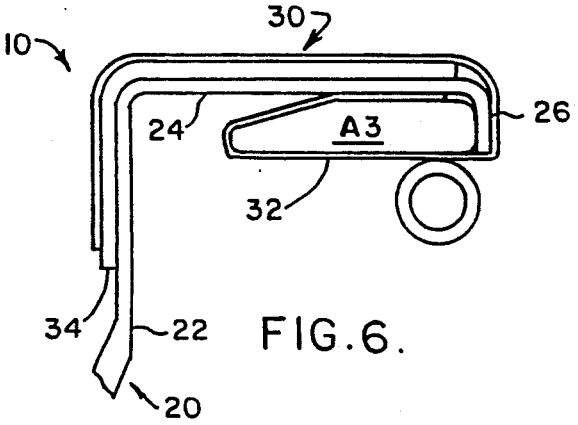
Figure 7:
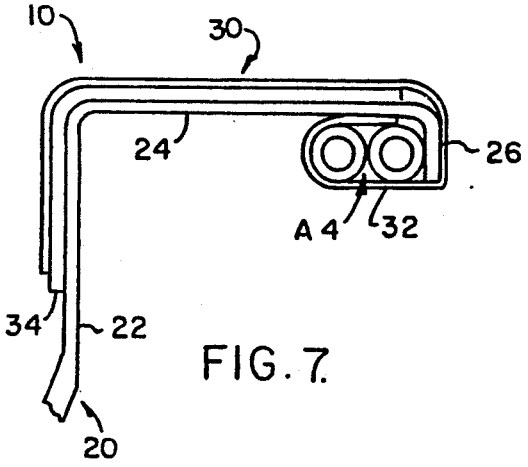
Figure 8:
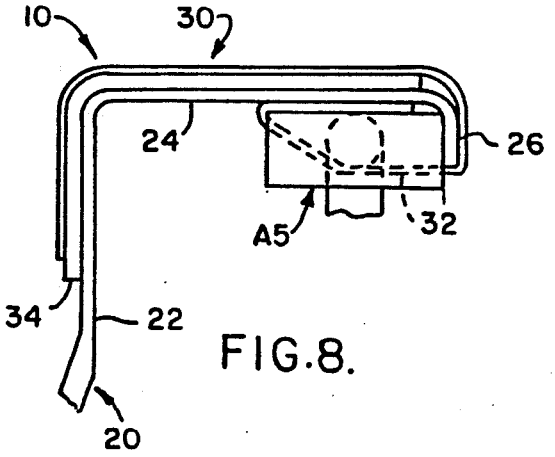

A support means 20 is connected to holder means 12, the support means supporting the holder means and the cup to one side of a chair arm A. As seen in FIGS. 4–8, the chair arm may be of variety of sizes and shapes A1–A5 respectively. In particular, it will be noted that the chair arm may be formed of tubular members A2 and A4 such as seen in FIGS. 5 and 7, a rectangular member Al as seen in FIG. 4, wooden and of outwardly tapering cross-section as seen for member A3 in FIG. 6, and a flat arm rest A5 fitting over a tubular support as seen in FIG. 8.

The support means includes a vertical support section 22 and a horizontal support section or arm 24. The length of vertical section 22 and of horizontal section 24 may be of any convenient length except that the vertical section shall be long enough to allow someone seated in the chair to easily reach the cup or container. A greater length of vertical support arm 22 will allow the top of the supported cup to be disposed below the level of the chair arm, preventing accidents caused by the user's elbow knocking over the cup. At the same time, the horizontal section is wide enough to comfortably span arm rests of any width. Lastly, the support means includes a downwardly extending retaining flange 26 which forms a lip fitting over the inner edge surface of the arm rest.

The horizontal section 24 of the support means sits upon the top of the arm rest of the chair, the retaining flange 26 and outer vertical section 22 each extending orthogonally downwardly from this horizontal section. Again as can be seen in FIGS. 4–8, the retaining flange 26 of the support means abuts the inner edge face of the arm rest. It will further be noted that the holder means and support means are integrally formed.

Next, cup holder 10 includes means 30 for attaching the cup holder to the chair arm. Means 30 first includes a strap 32 which is attached to the underside of horizontal support arm 24 of the support means. One end of the strap is secured to the underside of support arm 24 adjacent its juncture with retaining flange 26. The length of the strap is sufficiently long so it can extend substantially along the top of an arm rest, wrap around the outside edge and underside of the arm rest, up and around the inside of the chair arm, over retaining flange 26 of the support means, and over the top of horizontal support arm 24 as seen in FIG. 4. The attaching means further includes means 34 secured to the top of support arm 24 for securing the strap to the top of the support. The securing means comprises a strap of hook and eye material which extends substantially the length of the vertical support section 22 and substantially across the top of the horizontal support arm 24. The outer mating surface of strap 32 is also a hook and eye material. Preferably straps 32 and 34 are of a velcro material.

In use, the cup holder is set upon the top of the chair arm with the inner edge of the retaining flange 26 abutting the inside of the chair arm. Strap 32 is wrapped first along the top of the chair arm, then beneath the chair arm and up and over the outside of the support. Strap 32 is then pulled taut and pressed down upon strip 34 to secure the cup holder in place. Thereafter, an appropriate container can be set in the holder. Strap 32 binds the retaining flange tightly against the inner edge of the chair arm which greatly stabilizes the cup holder and prevents slippage. It is important that strap 32 is affixed on the underside of support arm 24 towards flange 26. This allows the strap to bind tautly against the outer edge of any size chair arm. If the strap was affixed further away from flange 26, the strap would not bear against the top surface of and outer edge of narrow chair arms, preventing a secure wrap. This would result in slippage of the cup holder.

It is important to understand that while other cup holders are known in the art, none are capable of use with the variety of leisure chairs as is the present invention. Different prior art constructions have been tested, but while some are useful with certain type chairs, and some with others, none has the adaptability of cup holder 10.

In view of the above, it will be seen that the other objects of this invention are achieved and other advantageous results obtained.

Various changes and modifications may be made within this invention as will be apparent to those skilled in the art. Such changes and modifications are within the scope and teaching of this invention as defined in the claims appended hereto.

What is claimed is:

1. A cup holder for removable attachment to an arm of a chair, said cup holder comprising a cup receptacle, support means, and securing means, said cup receptacle having means for supporting a cup therein, said support means being connected to said cup receptacle and being comprised of a single elongated, flat horizontal support arm having a downwardly depending retaining flange at a distal end thereof, said securing means being comprised of a binding strap connected to a bottom side of said horizontal support arm toward said distal end and spaced from said retaining flange, a top surface of said horizontal support arm having means for releasably securing said strap, whereby said horizontal support arm is placed on said arm of said chair such that an inner face of said retaining flange bears against said chair arm, and said binding strap is wrapped around said chair arm and secured to said top surface of said support arm, whereby said cup holder is secured to said chair arm.

2. The cup holder of claim 1 in which a surface of said binding strap is formed with hook and loop fastening material, and said top surface of said horizontal support arm is formed with a correspondingly mating hook and loop material, whereby said binding strap is releasably fastenable to said top surface of said horizontal support arm.

3. The cup holder of claim 2 in which said cup receptacle is connected to a vertical support arm, said vertical support arm being integrally connected with said horizontal support arm, whereby a cup is supported such that a top edge of said cup lies below the horizontal plane of said chair arm.

4. A method for removably attaching a cup holder to an arm of a chair, said cup holder comprising a cup receptacle, support means, and securing means, said cup receptacle having means for supporting a cup therein, said support means being connected to said cup receptacle and being comprised of a single elongated, flat horizontal support arm having a retaining flange at a distal end thereof, said securing means being comprised of a binding strap connected to a bottom side of said horizontal support arm toward said distal end and spaced from said retaining flange, a top surface of said horizontal support arm having means for releasably securing said strap, said method comprising placing said horizontal support arm on a top surface of said chair arm such that an inner face of said retaining flange bears against an inside edge of said chair arm, tightly wrapping said binding strap around outer and bottom edges of said chair arm and securing said strap to said top surface of said horizontal arm, whereby said retaining flange and said binding strap bear against said chair arm in securing relationship to support said cup holder on said chair arm.

5. The method of claim 4 in which a surface of said binding strap is formed with hook and loop fastening material, and said top surface of said horizontal support arm is formed with a correspondingly mating hook and loop material, whereby said binding strap is releasably fastenable to said top surface of said horizontal support arm.

* * * * *